United States Patent [19]

Brieger

[11] 4,142,583

[45] Mar. 6, 1979

[54] WELL TOOL PACK-OFF WITH SINKER BAR RELEASE MEANS

[76] Inventor: Emmet F. Brieger, Bonito Rte., Nogal, N. Mex. 88341

[21] Appl. No.: 830,176

[22] Filed: Sep. 2, 1977

[51] Int. Cl.[2] ..... E21B 21/00; E21B 23/00

[52] U.S. Cl. ..... 166/311; 166/120; 166/318

[58] Field of Search ..... 166/311, 63, 120, 318, 166/317, 212

[56] References Cited

U.S. PATENT DOCUMENTS

| | | | |
|---|---|---|---|
| 2,128,253 | 8/1938 | Johnson | 166/318 |
| 2,676,661 | 4/1954 | Crooke, Jr. | 166/318 |
| 2,729,293 | 1/1956 | Cloud | 166/120 |
| 3,954,138 | 5/1976 | Miffne | 166/317 |

*Primary Examiner*—James A. Leppink

[57] ABSTRACT

A tool sized for lowering through a tubing string disposed in a well bore by means of a wire line and activated upon exiting from the tubing string for setting a pack-off means to close off the cross-section of the tubing string. The wire line is releasable from the tool so that fluid can be removed from the tubing bore thereby producing a pressure differential across the tool. A sinker bar from the surface is dropped through the tubing string and, upon contact with the tool, actuates the tool to release the pressure differential so that the formations below the tubing string may suddenly produce fluid and thereby be cleaned. At the time of release of the pressure differential, the pack-off means is released so that the tool can subsequently drop from the end of the tubing leaving the tubing bore unrestricted.

15 Claims, 10 Drawing Figures

FIG. 5
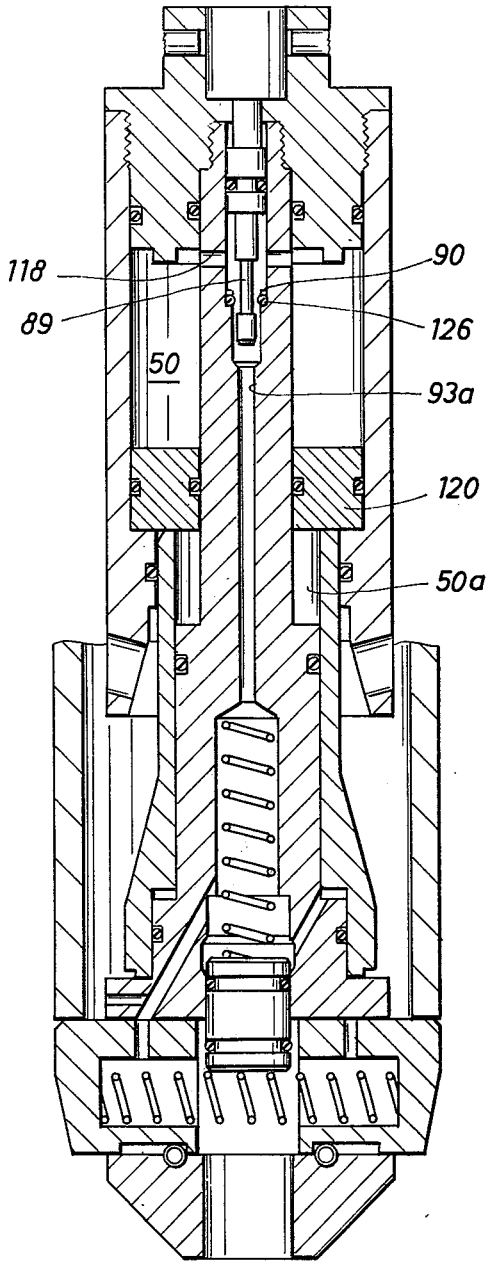
FIG. 6
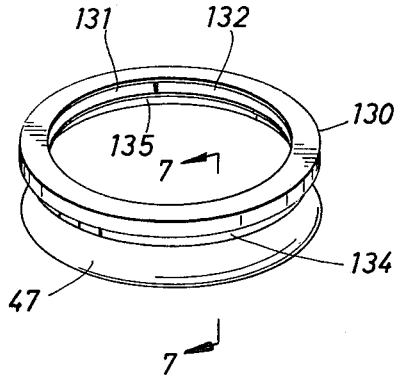
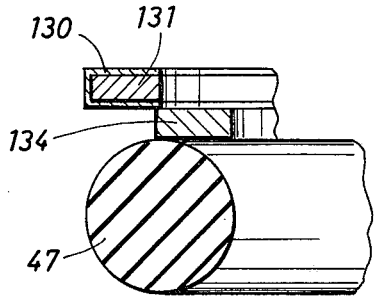
FIG. 7
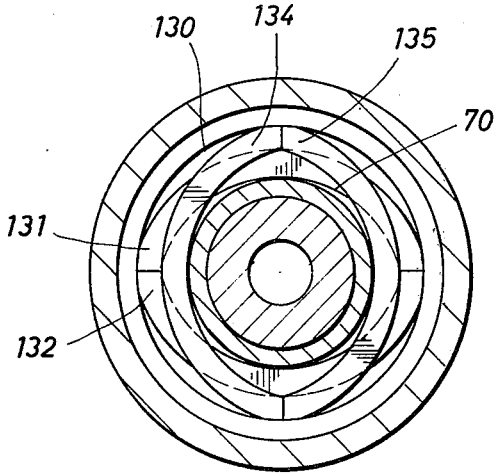
FIG. 8

WELL TOOL PACK-OFF WITH SINKER BAR RELEASE MEANS

FIELD OF THE INVENTION

This invention relates to tools and a system for use in a well bore traversing earth formations, and more particularly, to a tool adapted for passage through a tubing string which is disposed in a well bore and packed-off above a production zone where the tool is self-actuatable in the tubing string for packing off the cross-section of the tubing string and is releasable under conditions permitting a cleaning action to occur in perforations in the production zone.

BACKGROUND OF THE INVENTION

For the production of hydrocarbons from a well bore after the borehole is drilled, it is lined with a casing which is cemented in place to prevent fluid migration along the annulus between the casing and well bore. The interior of the casing is placed into fluid communication with the earth formations bearing the hydrocarbons under pressure by means of perforations which extend through the casing, the cement sheath and into the earth formations. The perforations are typically produced by a shaped charge gun which is lowered to the desired depth of the desired perforations while the bore to the earth's surface is filled with fluid which creates a hydrostatic pressure at the location for the perforation where the hydrostatic pressure is greater than the expected pressure of the hydrocarbons in the formations. Thus, when the perforations are produced in the formations, the pressure of the hydrocarbons is controlled by the greater pressure of the fluid in the bore. In the development of perforations by using shaped charges it has been established that a certain amount of metallic debris from the shaped charge invades the perforation and that the wall surface of a perforation is affected so as to reduce or adversely affect its permeability or ability to pass fluid. Thus, when the pressure differential is reversed by reducing the pressure in the bore, the fluid flow from the formations is not as significant as it might be in the absence of debris in the perforation or damage to the surface wall of the perforation. There are a large number of existing wells which were completed before this knowledge was available. It is thus desirable to revitalize older wells as well as wells currently being developed.

It is to the foregoing problems that the present invention is addressed. Previous efforts to solve these problems have included a number of approaches and, where the pressure differential across the perforation can be suddenly reversed, the attendant shock can act to unblock or "clean out" a perforation. Previous devices and systems for accomplishing this result have a number of drawbacks, the principal drawback being that an entirely separate operation is required from the completion operation and this typically involves substantial additional cost and risk in obtaining production from the well. By means of the present invention, the well can be set up for completion with a tubing and packer and the perforations are made. Thereafter, by use of the tool of the present invention, the perforations in the well can be easily cleaned up using a wire line which is an inexpensive and easy to accomplish operation.

SUMMARY OF THE PRESENT INVENTION

The present invention, briefly described, includes use of a tool by which the lower end of a packed off tubing string in a well bore is sealed off. While the tubing is sealed off the tubing string is swabbed to reduce the pressure at the lower end of the tubing string. Other means can be used to remove the fluid from the tubing bore. Below the tubing string, the pressure builds up to the formation pressure. The tubing string is either closed off or left open at the surface and the pack off of the tool is removed from the tubing string so that a sudden pressure differential occurs adjacent to the perforations and the perforations are flushed by a sudden flow of fluid from the perforations caused by release of the pressure differential.

The tool involves an assembly which can be passed through the bore of a tubing string at the end of a wire line. As the lower end of the tool exits from the end of a tubing string, latch members in the tool assembly automatically extend outwardly and release a first pressure differential arrangement in the assembly which causes a tapered expanding mandrel to set a sealing or pack-off element against the wall of the tubing string. The latch members prevent an upward movement of the assembly so that when a strain is taken on the wire line, a detachable cap releases the wireline from the assembly and the wire line and cap can be removed from the tubing string. After the cap and wire line are removed, the bore of the tubing string can be swabbed to remove fluid and thereby reduce the pressure at the lower end of the tubing string. Other methods can be used to reduce fluid pressure. After the pressure has been reduced, the swab is removed and a sinker bar can be dropped from the surface. Upon dropping of the sinker bar the well head can be closed off (or left open, if desired) and thereafter, the bar engages the assembly. Upon engagement of the sinker bar with the assembly, a second pressure differential arrangement in the assembly is released and the tapered mandrel releases the sealing or pack-off element. Upon release of the sealing element the release of the pressure differential causes fluid to surge from the perforations and perform a cleaning action of the perforations.

In the structure of the tool is a tubular assembly adapted for passage through a tubing string and carrying extendable latch members at its lower end. Upon extension of the latch members, a spring operated plug in the assembly opens an access passage to a first low pressure chamber to the pressure within the well bore. A slidable tapered extension sleeve on the tubular assembly has differential pressure areas so that the application of pressure the sleeve moves from a first position to a second position. In moving to the second position, normally retracted annular sealing element and back-up rings are extended into sealing engagement with the wall of a tubing string and seal-off the cross-section of the tubing string. A hollow cap member on the upper end of the assembly is connected by a shear pin to the tubular assembly and is released by taking a strain on an attached wireline. Upon release of the cap member, a plunger mechanism is exposed on the upper end of the tubular assembly. A sinker bar, upon engagement with the plunger mechanism, opens an access passage to another low pressure chamber so that the existent pressure below the tool acts on a piston to move the sleeve to its initial position thereby releasing the sealing element. The latch members prevent the assembly from going up the tubing bore and the tubular assembly can be discharged from the end of the tubing subsequently when the pressure is reduced.

BRIEF DESCRIPTION OF THE DRAWINGS

The present invention may be more easily understood, and will become more apparent from the following description when taken in conjunction with the drawings in which:

FIG. 5 is a view in longitudinal cross-section of the tool in a position just after the pack-off element has been released and illustrating the tool in a condition for discharge from the tubing string;

FIG. 6 is a view in perspective of the sealing ring and back-up elements;

FIG. 7 is a view taken along line 7—7 of FIG. 6;

FIG. 8 is a view in cross-section taken along line 8—8 of FIG. 5.

DESCRIPTION OF THE PREFERRED EMBODIMENT

Figure 1:
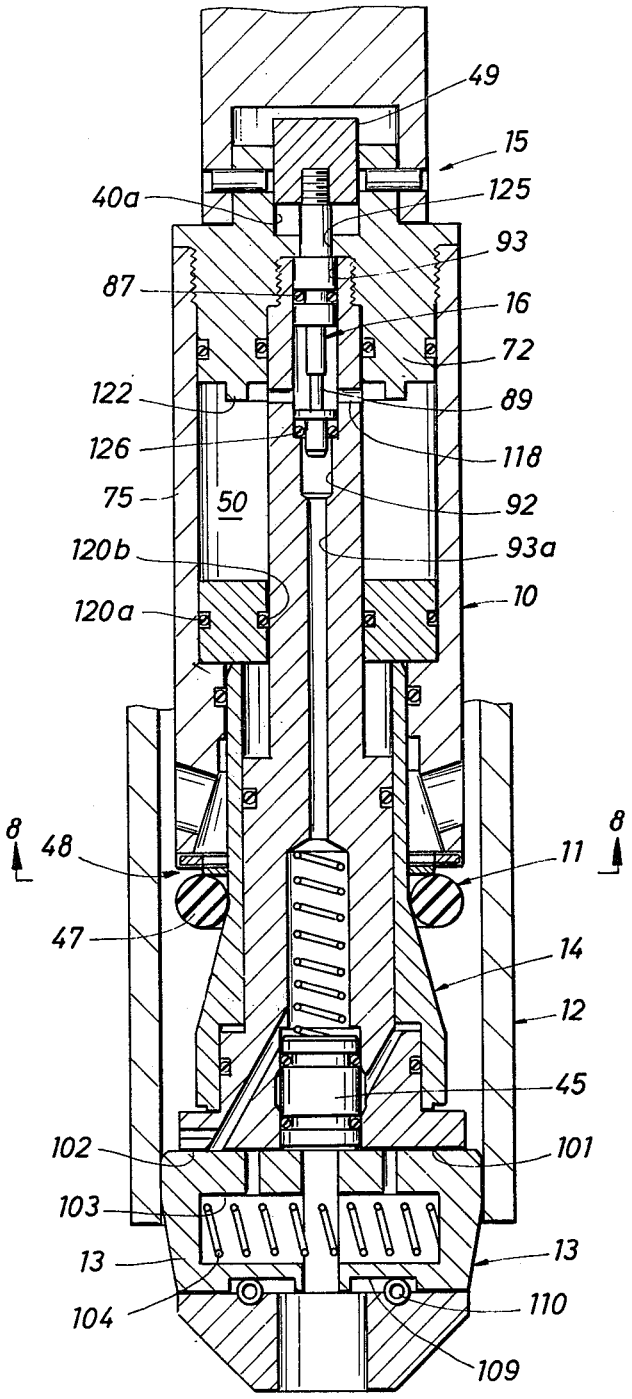
FIG. 1 is a detailed view in longitudinal cross-section through a surging tool in accord with the present invention.

Referring now to FIG. 1, a plug 10 in accordance with the present invention is illustrated in cross-section in a position or condition just prior to setting of a pack-off means 11. The plug 10 includes a tubular body assembly which is generally sized for passage through a tubing strip 12 which has a typical inner diameter of about two inches. The tubular assembly of the plug 10 includes a number of inter-related components which are generally operative:

1. to permit free passage of the tubular assembly through a tubing string at the end of a wire line;

2. upon the lower end of the tubular assembly exiting from the tubing string 12, for automatic release of a pair of latch members 13 to move from a contracted to an extended position which thereafter prevents upward movement of the tubular assembly and, upon release of the latch members, for actuating a pressure differential mechanism 14 to set a pack-off means 11 where the pack-off means 11 seals the internal bore of the tubing string 12 sealing off the cross-section against pressure generated in the well bore below the tubing string 12;

3. Upon setting of the pack-off means 11, permitting a strain to be taken on the wire line to release the wire line from the assembly upon shearing of a shear member releasing mechanism 15;

4. while the tubular assembly retains its pack-off condition by virtue of a pack-off means 11, permitting swabbing of the bore of the tubing string 12 above the assembly to create a pressure differential across the tubular assembly;

5. to release the pack-off means 11 and accomplish the purging function when a sinker bar is dropped from the surface and, upon engagement of the sinker bar with the tubular assembly, for actuating another pressure differential means 16 in the tubular assembly and releasing the pack-off means 11 and, upon release of the pack-off means 11, permitting the tubular assembly to be discharged from the end of the tubing string 12 and to drop to the bottom of the well bore together with the sinker bar.

Figure 2:
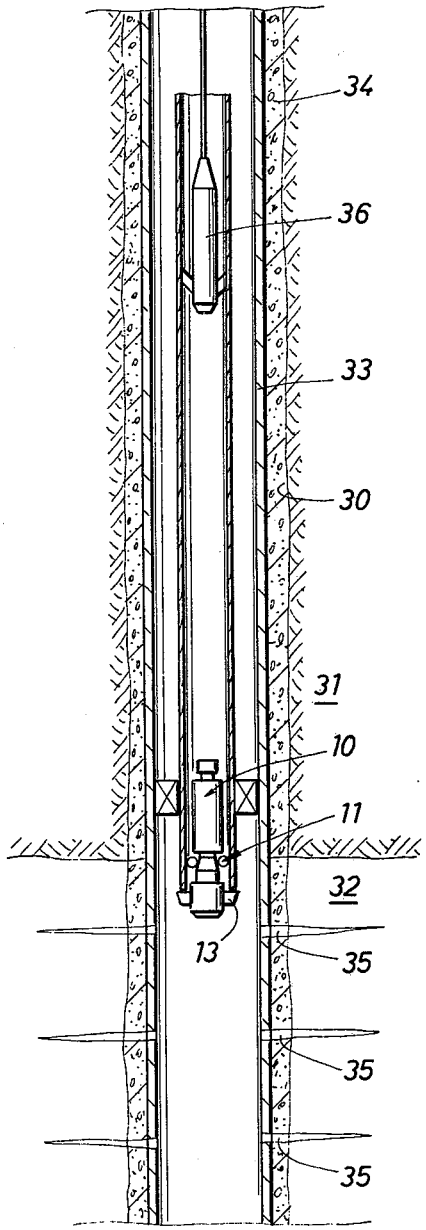
FIG. 2 is a schematic illustration of the tool of the present invention in the context of a well operation.
Figure 9:
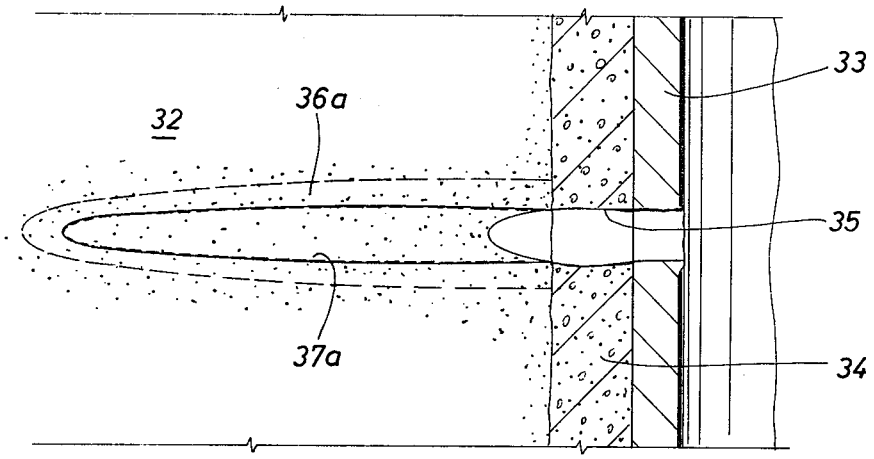
FIG. 9 is a view in cross-section through a perforation and illustrating compaction and debris.
Figure 10:
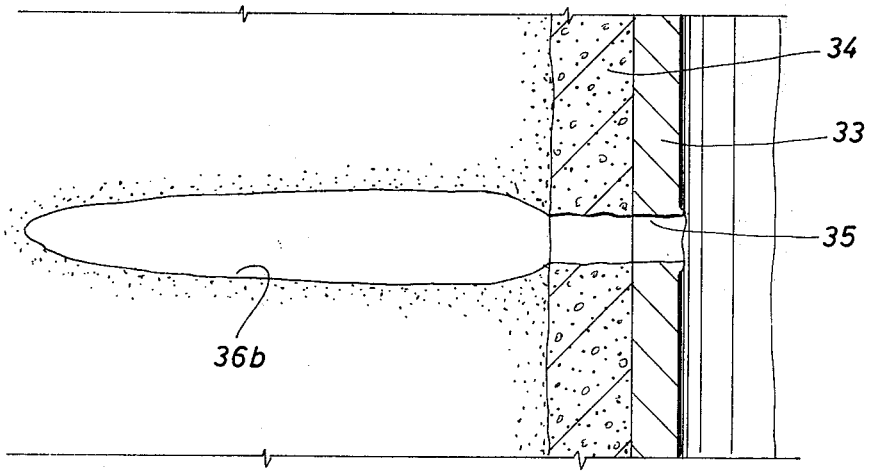
FIG. 10 is a view in cross-section through a perforation as illustrated in FIG. 9 after the purging operation of this invention.

Before detailing the structure of the plug, the overall system will be described. As illustrated in FIG. 2, a well bore 30 traverses earth formations 31, 32 and is lined with a casing 33 which is cemented in place by a sheath of cement 34. The casing 33, cement 34 and earth formations 32 are penetrated by perforations 35. The perforations 35 may be formed in any number of ways but most commonly are formed by shaped charges and, in a larger number of instances, contain debris and sometimes are made relatively impermeable for a variety of reasons. As illustrated in FIG. 9, the perforation 35 is an elongated, generally cylindrically shaped opening which tapers to a nose section at **35*a*. A wall section 36*a* of finite thickness surrounds the opening 36 and is compacted and has a relatively low permeability. Metal debris 37*a* is lined along the wall surface 36*a*. The pressure of fluid in the permeable earth formations 32 is sufficient generally to produce greater quantities of fluid from the formations if the debris and impermeability is removed. In the present invention, the bore of the well is blocked off and a volume of low pressure atmosphere is created in a vicinity or location close to the perforations. The blocking of the well is suddenly removed so that the pressure of the fluids in the formation is opened to the low pressure atmosphere. The sudden effect of opening the perforations to a low pressure atmosphere shocks or produces a sudden surge of fluid which cleans or discharges the debris from the perforations. As illustrated in FIG. 10, the cleaning operation removes the debris 37*a* as well as the wall section 36*a* thereby producing an enlarged opening defined by a wall surface 36*b***. The permeability is improved as well as the surface area available for production.

To accomplish the foregoing steps, the plug 10 is lowered on a wire line until the latches 13 clear the end of the string of tubing 12 and automatically extend outward. Upon extension of the latches 13, the pack-off means 11 seals off the cross-section of the tubing. At this time, the plug holds or seals off the cross-section of the tubing against pressure in the well bore below the tubing string. Next, fluid or liquid in the tubing string above the plug 10 is removed as, for example, by a wire line swab 36. The tubing string can be swabbed down to any desired pressure, for example, reduced to atmospheric pressure if all of the fluid is removed. At this time there is a higher pressure below the plug than above. A sinker bar can then be dropped from the surface and the well closed in at the surface with a conventional well head device. If the pressure can be controlled, the tubing can be left open to the atmosphere. When the sinker bar engages the pressure differential means 16, the pack-off means 11 is suddenly released and the fluid under pressure is projected up the tubing string in a surge which probably will move the sinker bar upwardly in the tubing bore. The plug is restrained from moving up the tubing bore by the latches 13. Subsequently when the pressure normalizes the sinker bar will drop downwardly and the plug and sinker bar pass out of the tubing string and drop to the bottom of the well bore.

Figure 3:
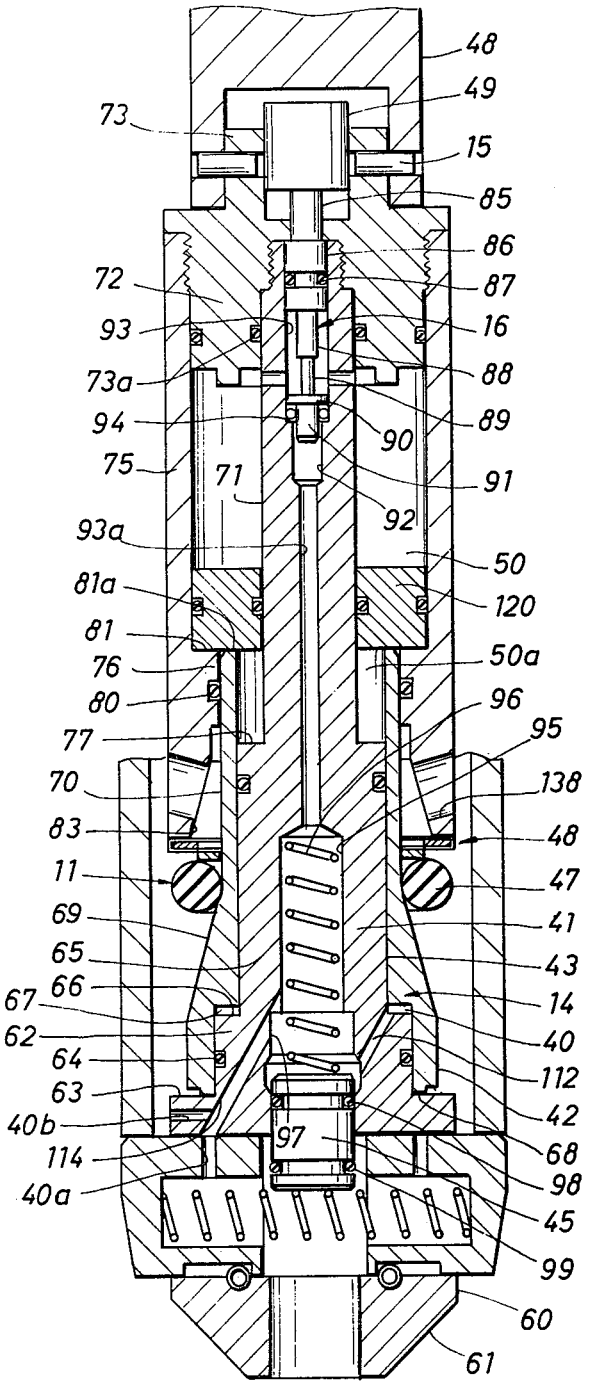
FIG. 3 is a view in longitudinal cross-section of the tool in a position just after the lower latch members are passed from the end of a tubing string.

Referring again to FIGS. 1, 3, 4 & 5, the structure for accomplishing the above functions generally includes a number of components in the tubular body assembly which will be hereafter described. At the lower end of the body assembly are the spring biased latch members 13 which are normally retracted and, upon passing through the bottom of the tubing string 12, spring outwardly beyond the end of the tubing string. This condition is generally illustrated in FIG. 3. A first pressure differential mechanism 14, is provided by a chamber 40 formed between the tubular body mandrel 41 and an expansion sleeve 42 slidably mounted on the body mandrel 41. Atmospheric pressure in the chamber 40 and differential pressure across thin wall 70 create a condition whereby the expansion sleeve 42 is maintained in a lower, retracted condition. When the latch members 13 are released, a cylindrical plug 45 is also released which opens the atmospheric chamber 40 to the well bore pressure in the tubing string by virtue of Ports 40*a*, 40*b*, 114 and 112. (See FIG. 3). By virtue of the differentially sized areas 43, 44 the expansion sleeve 42 travels upwardly to a upper position. In the travel of the sleeve upwardly, (See FIG. 4) the expansion sleeve 14 extends a sealing member 47 into engagement with the interior wall of the tubing string 12 and also extends a back-up mechanism 48 into supporting position behind the sealing member 47. At the upper end of the body mandrel 41, a cap member 48 is attached to the body mandrel 41 by a shear pin 15. Upon extension of the latch members 13 beyond the end of the tubing string, a strain can be taken on the attached line wire (not shown) and the cap member 48 can be separated from the body mandrel 41. Upon release of the cap member 48 from the body mandrel 41, a hammer pin 49 is exposed in an extended position above the body mandrel 41. When a sinker bar engages the hammer pin 49, the hammer pin 49 is moved downwardly connecting the pressure below the pack-off means 11 to a second pressure differential means 16. The second pressure differential pressure means 16 includes a chamber 50 at atmospheric pressure. When the well bore pressure within the tubing string 12 below the sealing means 11 is admitted to the chamber 50, the expansion sleeve 42 is moved downwardly to its initial position thereby releasing the pack-off means 11 and the body mandrel and conditioning the assembly for subsequently dropping out of the bottom of the tubing string.

The apparatus for accomplishing the above functions includes the body mandrel which can be constructed from one or more interconnected parts and includes a lower latch housing 60 which is generally cylindrical in shape with a conically shaped nose 61. Above the housing 60 is a first cylindrical portion 62 with a reduced diameter relative to the diameter of the latch housing 60 so as to form a shoulder 63. Along the length of the cylindrical portion 62 is a O-ring groove for receiving an O-ring sealing member 64. Above the first cylindrical portion 62 is a second cylindrical portion 65 with a reduced diameter relative to the first cylindrical portion thereby forming a shoulder 66. The tubular expanding sleeve 42 is slidably mounted on the first and second cylindrical portions 62, 65 and has an internal, downwardly facing shoulder 67. In the initial position of the expanding sleeve 42, it has a lower end 68 engaging the housing shoulder 63 and the atmospheric chamber 40 is provided between the shoulders 66, 67 and side walls. The expanding sleeve 42 has a conically tapered surface 69, which tapers inwardly to a upper thin-walled tubular section 70. Above the second cylindrical portion 65 is a third cylindrical portion 71 which has a reduced diameter relative to the second cylindrical portion 65. The third cylindrical portion 71 is attached to a cylindrically shaped head member 72 and sealed with respect thereto to an O-ring 73*a* in an O-ring groove. The head member 72 has an upper cylindrical projection 73 which receives the hollow cap member 48. The cap member 48 is secured to the cylindrical projection 73 by the shear pin 15. Attached to the outer part of the head member is a downwardly extending thin-walled member 75 which has an inwardly extending flange 76 located just above the shoulder 77 between the second and third cylindrical portions 65, 71. The flange 76 extends inwardly to slidably receive the upper end 70 of the expanding sleeve 42 and has an O-ring sealing means 80 for sealing with respect to the expanding flange. The flange 76 forms an upwardly facing shoulder 81 which is generally co-planar with respect to the upper end 81*a* of the expanding sleeve in the position illustrated. Below the flange 76 is a downwardly and outwardly tapered surface 83 which is tapered at the same angle as the tapered surface 69 on the expanding sleeve 42.

The body mandrel has a series of different diametered bores throughout its length. Beginning in the head member 73, the cylindrically-shaped hammer head 49 is connected by a cylindrically shaped stem portion 85 to a sealing stem 86. The sealing stem 86 is enlarged relative to the stem portion 85 and carries an O-ring sealing means 87. Below the sealing stem 86 is a smaller diameter connecting stem 88 with an inwardly stepped section 89 which connects to a shear flange 90. Below the shear flange 90 is a nose section 91. The nose section 91 has its lower end loosely received in a bore portion 92. Above the bore portion 92 is an enlarged bore portion 93 so that an upwardly facing shoulder 94 is provided. Between the shoulder 94 and flange 90 is an O-ring seal. When the hammer 49 is actuated, the shear flange 90 engages the shoulder 94 and the annular flange ring is sheared from the stem. Upon shearing the flange ring the stepped section 89 is disposed above and below the sheared flange 90 thereby permitting a fluid bypass. In the third cylindrical section 41 an interconnecting bore 93*a* extends between the upper bore section 92 and a lower spring bore section 95. The spring bore section 95 is enlarged to receive a spring 96 and has a lower outwardly stepped bore 97 which receives a cylindrical sealing plug 45 provided with spaced O-rings 98, 99.

Extending transversely through the lower member 60 are rectangularly shaped slots 101, 102 which are sized to slidably receive latch blocks 13. Each latch block has a hollow interior 103 so that a spring 104 can be disposed between the latch blocks 13. When the latch blocks 13 are moved inwardly, the spring 104 is compressed and the upper surfaces of the latch members prevents downward movement of the sealing plug 45. In this position, the spring 96 is also compressed. Each latch block 13 on its bottom surface has a groove 109 which receives a pin 110. A latch block 13 is movable to the extent permitted by the groove 109 and pin 110.

A first pressure passageway 112 is disposed in the tubular member to extend between an opening intermediate of the seals 98, 99 on the sealing plug 45 and the first atmospheric chamber 40. A second pressure passageway 114 is disposed between a slot 101 and the interior of the bore 98. The latch blocks 13 are also provided with ports 116 for fluid access to the second passageway 114. Ports 118 are provided in the wall of the tubular member at a location just below the head member 72 for placing the bore 92 in fluid communication with the annular chamber 50 formed between the outer wall 75 of the tubular member and the inner wall surface of the tubular member. A piston member 120 is slidably received in the annular chamber 50 and has outer and inner sealing mechanisms 120*a*, 120*b*. At the upper end of the chamber is a depending annular projection 122 for spacing the piston 120 from the upper wall of the chamber 50 and providing access for pressure through the ports 118. Below the piston member 150 is another sealed chamber 50*a* at atmospheric pressure.

In the upper end of the tubular assembly, the bore 93 is disposed intermediate of upper and lower smaller diametered bores 125, 92. The stem at its upper end projects upwardly and is attached to the cylindrically shaped hammer pin 49 disposed in a pin bore 40*a*. The hammer pin 49 normally projects beyond the end of the head member 73. In the position shown, the seals 87 and 126 effectively isolate the ports 118 and chamber 50 from the bore 93*a* below the seal 126. Upon actuation of the hammer pin 49 by a sinker bar, the stem is moved downwardly shearing the ring 90 and permitting the bypass 89 to place the bore 93*a* in communication with the ports 118 and chamber 50 above the piston 120.

In order to prevent the sealing means 47 from blowing out and to provide support for increased pressure, back-up means 48 are provided for the sealing element. The back-up means as shown in FIGS. 6–8 include an annular ring 130 of elastomer material having a U-shaped configuration with the open portion of the "U" facing inwardly. Disposed with the confines of the ring 130 are separate, arcuate segments 131, 132 which are about 180° each. The rings have a general curvature which corresponds with the tubing wall. Below the rings 130 is a second set of arcuate segments 134, 135 which are rotated with respect to rings 131, 132 so that solid portions of one set of segments overlie the openings between the ends of an adjacent set of segments. The second set of segments 134, 135 is nested against the outer surface of sleeve 70 and rests on the annular sealing element 47. As illustrated in FIG. 1, the ring 47 is disposed the expanding sleeve 42 and retains the segments 134, 135 against the end of the housing part 76. The housing part 76 has fluid access bores 138 in the tapered portion 83.

Figure 4:
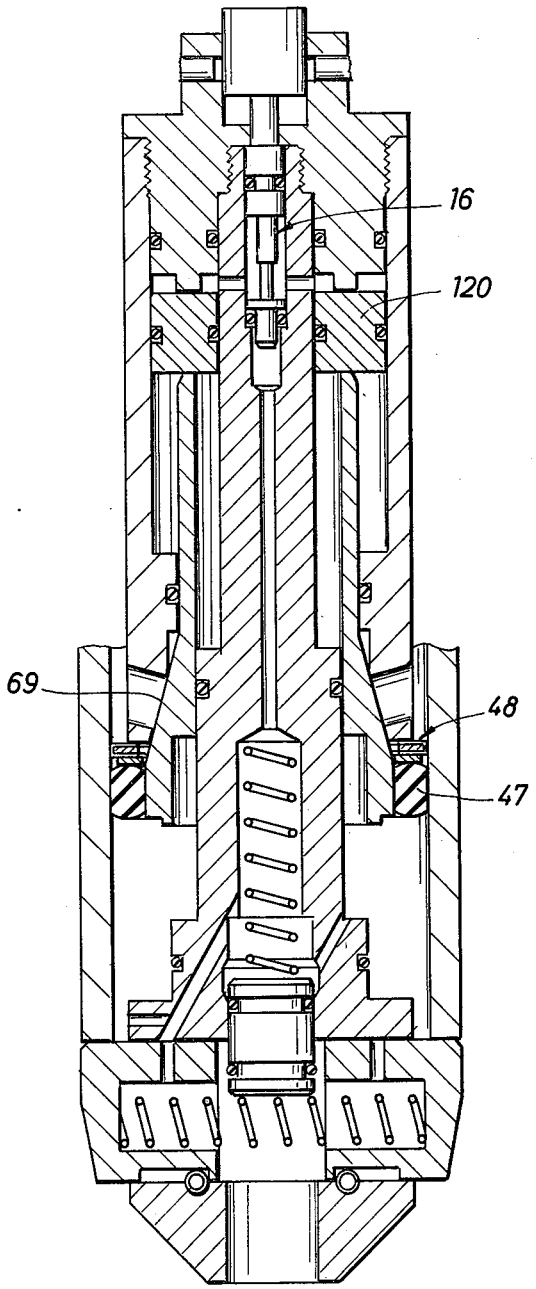
FIG. 4 is a view in longitudinal cross-section of the tool in a position just after the pack-off means is set in a sealing position.

In regard to the functioning of the tool, the parts are carried in the position shown in FIG. 1 while being lowered through the tubing on a wire line. The wire line is attached to the hollow cap 48 which is shear pinned to the head 72 and protects the hammer pin 49. When the lower end of the tool exits from the tubing the latches 13 automatically are projected outwardly by the spring 104 and the sealing plug 45 is moved downwardly by the spring 96. (See FIG. 3) When the sealing plug 45 is moved downwardly, the passage 112 is opened to the pressure in the well bore and the sleeve 42 with the differential areas is moved upwardly setting the sealing element 41 and back-up elements 48 and the tool assumes the position as shown in FIG. 4. Also as shown in FIG. 4, the cap 48 is removed to expose the hammer pin 49. To release the tool, a sinker bar is dropped and the stem shifted so that pressure from the well bore is applied to the piston 120. Pressure applied to the piston 120 moves the expanding sleeve 42 back to its initial position and the sealing element 47 is blown out of the way by the fluid surging up the tubing bore by virtue of the pressure differential (See FIG. 5) At this point there is no restraint on the tool and it can be discharged subsequently from the lower end of the tubing string.

While particular embodiments of the present invention have been shown and described, it is apparent that changes and modifications may be made without departing from this invention in its broader aspects, and, therefore, the aim in the appended claims is to cover all such changes and modifications as fall within the true spirit and scope of this invention.

What is claimed is:

1. A method for flushing perforations in earth formations traversed by a cased well bore wherein a tubing string extends between a surface wellhead to a downhole packer location and has its lower open end arranged for fluid communication with perforations extending through such cased well bore and into earth formations, including the steps of:

lowering a pack-off device through a tubing string where such device automatically sets itself against movement in a upper direction and provides a fluid-tight pack-off of such device with respect to the tubing string so that the pressure below the pack-off is that of the earth formation traversed by perforations;

reducing the pressure above the pack-off for creating a pressure differential with respect to the pack-off;

dropping a bar from the surface for engaging the pack-off device and suddenly releasing the pack-off thereby causing the sudden flow of fluid from such perforations for cleaning of such perforations.

2. The method as defined in claim 1 wherein said method includes lowering the pack-off device on a wire line and removing the wire line before reducing the pressure and includes reducing the pressure by removing fluid from the tubing string above the pack-off.

3. Apparatus for use in well bores comprising a well tool sized for passage through a tubing string, said well tool including:

an elongated body assembly sized for passage through a tubing string, latch means or said body assembly for latching said body assembly with respect to the tubing string and preventing movement of the body assembly upwardly with respect to the tubing string, pack-off means on said body assembly for sealing the cross-section of the body-assembly with respect to the tubing string to withstand a pressure differential; actuating means for actuating said pack-off means to a sealing position; and means on said body assembly for releasing said pack-off means from a sealing position in response to an impact member dropped through the tubing string.

4. The well tool as defined in claim 3 where said tubing string has a location at which said tubing string and said latch means have cooperating means for latching said body assembly against upward movement with respect to the tubing string.

5. The well tool as defined in claim 4 wherein said latch means includes latch members which are normally retracted while said body assembly is in a tubing string and normally extendable when said latch members are not in a tubing string.

6. The well tool as defined in claim 5 and further including means for normally resiliently biasing said latch members outwardly from said body assembly.

7. The well tool as defined in claim 3 wherein said pack-off means includes a normally retracted, annular, elastomer element and said actuating means includes relatively movable expanding means movable between a first position where said elastomer element is retracted and a second position where said elastomer element is extended for sealing engagement with the bore of the tubing string.

8. The well tool as defined in claim 7 wherein said body assembly includes back-up means for said elastomer element which are extendable from a normally retracted position into a position juxtaposed to the well of the tubing string in response to movement of said expanding means.

9. The well tool as defined in claim 7 and further including means for retaining said expanding means in said first position including a first low pressure differential chamber defined by differential areas on said expanding means and said body assembly and containing a low pressure atmosphere; and means responsive to operation of said latch means for coupling said first pressure chamber to the pressure below said body assembly whereby said expanding means can be moved to extend said elastomer element.

10. The well tool as defined in claim 9 and further including a second low pressure chamber defined within said body assembly and containing a low pressure atmosphere, and means on said body member responsive to impact of an impact member for coupling said second pressure chamber to the pressure below said body assembly whereby said expanding means can be returned from a position extending the elastomer element toward a position releasing said elastomer element.

11. Apparatus for use in well bores comprising a well tool sized for passage through a tubing string, said well tool including:

an elongated body assembly sized for passage through a tubing string, said body assembly having normally retracted pack-off means, where said pack-off means are extendable for sealing off the cross-section of a tubing string; means on said body assembly for extending said pack-off means including relative movable expansion members on said body assembly;

means for retaining said expansion members in a first position wherein said pack-off means are retracting, said retaining means including a first low pressure chamber, said expansion members being relatively movable from said first position to a second position where said pack-off means are extended when said first low pressure chamber is placed in communication with pressure in the tubing bore;

means for relatively moving said expansion members from said second position toward said first position thereby releasing said pack-off means, said moving means including a second low pressure chamber, said expansion members being movable from said second position toward said first position when said second low pressure chamber is placed in communication with the pressure in the tubing bore;

latch means on said body assembly for latching said body assembly against upward movement with respect to a tubing string, said latch means being actuatable at a location along a tubing string; means responsive upon actuation of said latch means for placing said first low pressure chamber in communication with the tubing bore thereby extending said pack-off means for sealing off the cross-section of a tubing string;

impact means on said body assembly responsive to an impact member for placing said first low pressure chamber in communication with the tubing bore thereby releasing said pack-off means.

12. The well tool as defined in claim 11 wherein said impact responsive means is located at the upper end of said body assembly and projects upwardly therefrom;

hollow cap means disposed over said impact responsive means for protecting said impact responsive means from premature actuation, said cap means being adapted for coupling to a wire line, and means for shear coupling of said cap means and said body assembly to one another.

13. The well tool as defined in claim 11 wherein said pack-off means is an annular elastomer ring and one of said expansion members has a tapered surface for expanding said elastomer ring, back-up means disposed about said body assembly and responsive to said one expansion member for expanding outwardly for providing a back-up for said pack-off means.

14. The well tool as defined in claim 11 wherein said latch means are normally retracted in a tubing bore and expandable upon reaching a bore enlargement, means in said body assembly responsive to expansion of said latch means for placing said first low pressure chamber in communication with a tubing bore.

15. The well tool as defined in claim 11 wherein said moving means includes a piston member slidably disposed in said second low pressure chamber and arranged to contact one of said expansion members, said impact means including a shear member releasably holding said impact means in a first position and releasable upon impact for coupling the tubing bore to said second chamber.

* * * * *